United States Patent [19]

Sinkes

[11] Patent Number: 4,463,748

[45] Date of Patent: Aug. 7, 1984

[54] INSULATING APPARATUS FOR A FLUE THIMBLE

[76] Inventor: Donald W. Sinkes, R.R. 6, Box 291, North Vernon, Ind. 47265

[21] Appl. No.: 484,902

[22] Filed: Apr. 14, 1983

[51] Int. Cl.[3] ..... F23J 13/00

[52] U.S. Cl. ..... 126/314; 126/316

[58] Field of Search ..... 126/314–319, 126/307 R, 312, 80; 52/219; 98/46, 58, 60

[56] References Cited

U.S. PATENT DOCUMENTS

| | | | |
|---|---|---|---|
| 55,268 | 6/1866 | Fitch | 126/316 |
| 313,342 | 3/1885 | Kingsland | 126/314 |
| 386,166 | 7/1888 | Schaab | 126/315 |
| 393,121 | 11/1888 | Packham | 126/316 |
| 402,778 | 5/1889 | Staub | 126/314 |
| 843,797 | 2/1907 | Dauben et al. | 52/219 |
| 894,455 | 7/1908 | McLean | 126/316 |
| 922,714 | 5/1909 | Meredith | 52/219 |
| 1,160,954 | 11/1915 | Parker | 126/80 |
| 2,464,084 | 3/1949 | Helt | 126/315 |
| 2,687,127 | 8/1954 | Leffler | 126/307 R |

FOREIGN PATENT DOCUMENTS

| | | | |
|---|---|---|---|
| 18835 | of 1909 | United Kingdom | 126/316 |

*Primary Examiner*—James C. Yeung

*Attorney, Agent, or Firm*—Woodard, Weikart, Emhardt & Naughton

[57] ABSTRACT

An insulating apparatus for mounting within a wall opening and for receiving therein a flue thimble. The apparatus includes a double-walled, cylindrical body member within which the flue thimble is received. The body member defines an annular insulating chamber closed at one end and open at the other to permit air circulation therethrough. A flange extends ouwardly from one end of the body member and is sized to cover the opening of the wall. A cover plate is mounted over the body member and includes a central opening for reception of a vent pipe therein. The cover plate also includes apertures which overlie the open end of the annular chamber to provide air access thereto.

5 Claims, 3 Drawing Figures

INSULATING APPARATUS FOR A FLUE THIMBLE

BACKGROUND OF THE INVENTION

1. Field of the Invention

The present invention relates to the field of stoves, furnaces and the like which have flues vented through a wall, and more particularly to an apparatus for providing insulation of the wall against the heat in such vents.

2. Background of the Invention

Various types of stoves, furnaces and the like include vent pipes for exhausting combustion products through a wall or ceiling to the outside of a building. Since the vent pipes can become quite hot, it is necessary to insulate the wall or ceiling against such heat. This is particularly true in the case of wood frame buildings which could become damages, or catch fire, as a result of exposure to this considerable heat.

It is presently common to employ a structure known as a flue thimble to connect the vent pipe on the interior of a building with the exterior chimney. A flue thimble typically comprises a cylindrical piece of formed masonry which extends from a point flush with the inside of the dwelling wall to a point inside of the masonry flue lining of the chimney. The vent pipe is telescopingly received within the flue thimble, and in common applications the only insulation for the wall is the thimble itself.

Modified forms of the flue thimble have been proposed in the prior art. In U.S. Pat. No. 1,160,954, issued to Parker on Nov. 16, 1915, there is described a heating stove which utilizes a specialized form of a flue thimble. The Parker patent discloses a vertical venting pipe which is separate from the stove and is positioned adjacent the exterior wall. The top end of the vertical pipe connects with a horizontal pipe that extends through the exterior wall and is open at the outside end. The vent pipe coming from the stove extends into and through the horizontal pipe to a location about in the center of the exterior wall. Air is thereby permitted to move upwardly through the horizontal pipe and around the vent pipe of the stove, at which point it combines with the exhaust air of the stove and passes to the outside of the building. Since the air from the vertical pipe passes around the vent pipe of the stove, a degree of dilution of the exhaust air of the stove is accomplished, thus reducing the temperature to which the exterior wall is exposed.

Another modified flue thimble is described in U.S. Pat. No. 386,166, issued to Schaab on July 17, 1888. The Schaab device actually utilizes a plurality of flue thimbles which are concentrically received within one another to accomodate vent pipes of different sizes. Each smaller thimble is secured to the adjacent, outer one, and is removable therefrom in the event that the size of the vent pipe requires a larger opening. A relatively simple flue thimble is described in U.S. Pat. No. 2,464,084, issued to Helt on Mar. 8, 1949. The Helt device includes a rectangular conduit mounted within the exterior wall, and two plate halves which are mounted from opposited sides of the vent pipe to engage the pipe and cover the surrounding area of the rectangular conduit.

Other variations of the flue thimble have also been described. Examples of other types of modified forms are contained in U.S. Pat. Nos. 2,687,127, issued to Leffler on Aug. 24, 1954; 922,714, issued to Meredith on May 25, 1909; 843,797, issued to Dauben et al. on Feb. 12, 1907; and 458,416, issued to Devore on Aug. 25, 1891.

SUMMARY OF THE INVENTION

Briefly describing one aspect of the present invention there is provided an insulating apparatus for mounting within an opening in a wall or the like for receiving a flue thimble extending through the wall opening. The apparatus includes a double-walled, cylindrical body closed at one end and having apertures at the other end to provide for air cirulation within. A flange extends outwardly at the apertured end to rest against the interior surface of the wall. The body is size to receive the flue thimble therein and is mounted to the flue thimble to be spaced therefrom.

It is an object of the present invention to provide an insulting apparatus which protects an exterior wall against the heat within a vent pipe and/or flue thimble which extends through the wall.

Another object of the present invention is to provide an apparatus which is readily installed, and which has a desirable, aesthetic appearance from inside of the wall.

A further object of the present invention is to provide an apparatus which is adaptable for a variety of applications.

Further objects and advantages of the present invention will become apparent from the description of the preferred embodiment which follows.

DESCRIPTION OF THE PREFERRED EMBODIMENT

Figure 1:
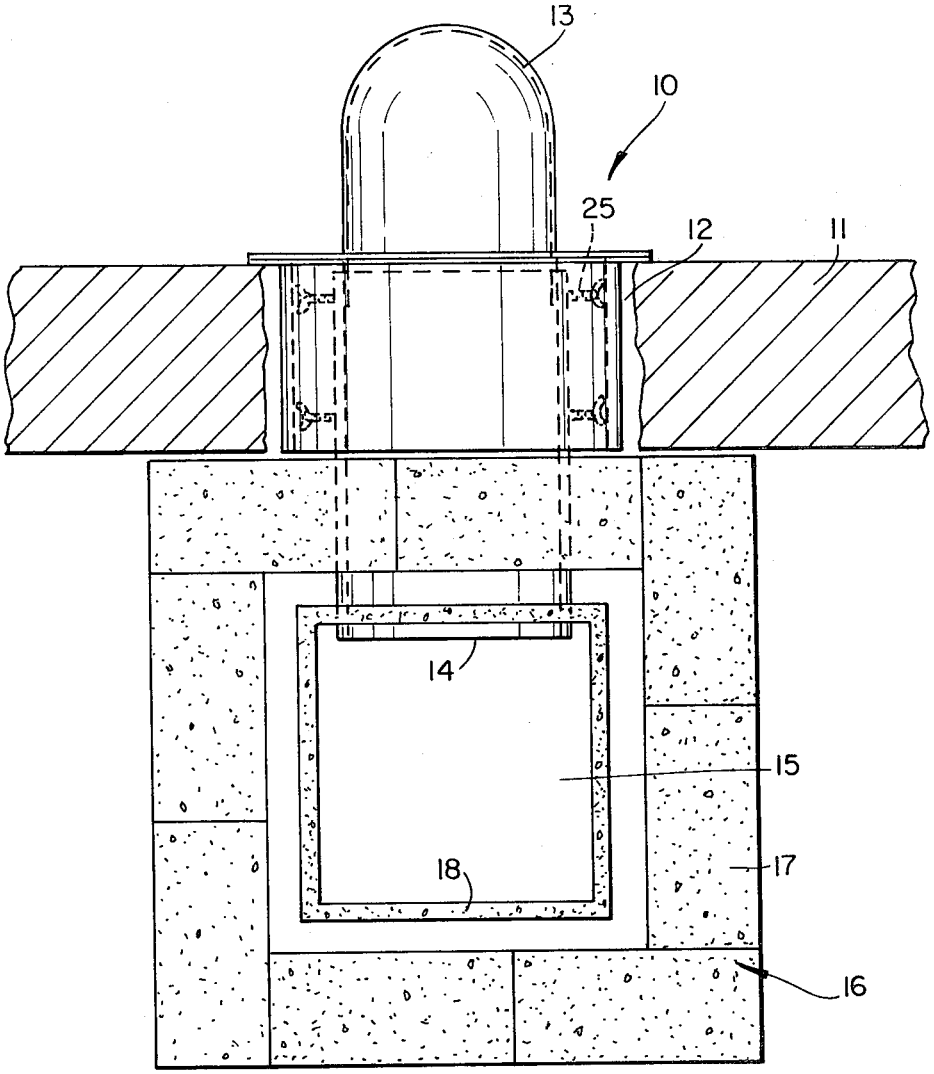
FIG. 1 is a top, plan view of an insulating apparatus in accordance with the present invention, and particularly shown as mounted within a wall and receiving a flue thimble therein.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to the drawings, there is shown an insulating apparatus 10 constructed in accordance with the present invention. The apparatus is constructed for mounting within an opening in a wall 11 or the like, such as a ceiling. As used herein, the term wall is used in the general sense of a partition which may include a vertical wall, ceiling or roof.

The wall 11 includes an opening 12 to permit the vent pipe 13 of a stove, fireplace or similar unit to pass from within the dwelling, either as a continuing vent pipe or connecting to an exterior chimney. The vent pipe is received by a flue thimble 14, which in turn connects with the smoke chamber 15 of the chimney 16. The chimney may for example be constructed of bricks 17 surrounding a flue lining 18 and spaced slightly therefrom. In conventional fashion the flue thimble comprises a circular piece of formed masonry which extends from a point flush with the inside of the dwelling wall to inside of the masonry flue lining.

The present invention provides an apparatus for insulating the wall adjoining the flue thimble against the heat contained by the flue thimble. In particular, the present device is mounted to surround the flue thimble, and to provide a plurality of insulating air spaces between the flue thimble and the wall.

Figure 2:
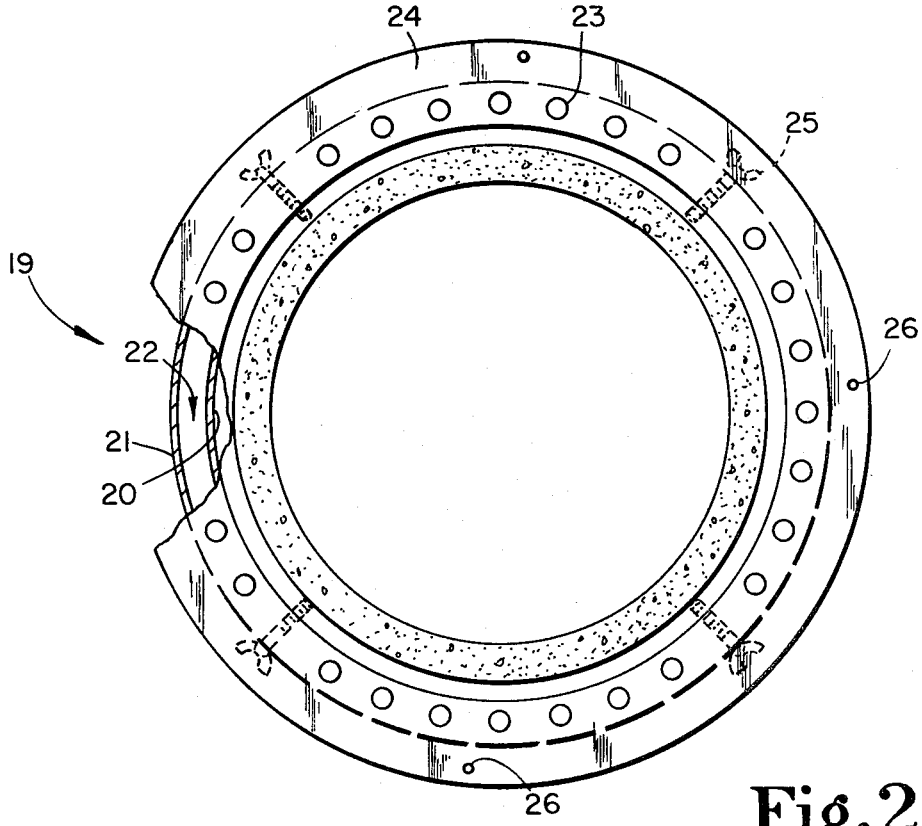
FIG. 2 is a front, elevational view of a cylindrical body member useful in the insulating apparatus of the present invention.

The insulating apparatus 10 includes a double-walled, cylindrical body member 19 having an inner cylindrical wall 20 and an outer cylindrical wall 21 (FIG. 2). An annular, insulating chamber 22 is defined between the inner and outer cylindrical walls. As shown in FIG. 1, the inner diameter of the inner cylindrical wall 20 is greater than the outer diameter of the flue thimble 14 to enable the flue thimble to be received inside of the inner cylindrical wall. The outer diameter of the outer cylindrical wall 21 is less than the size of the opening 12 in the wall 11 to enable the cylindrical body member to be received within the wall opening.

The body member 19 includes a front wall extending between the front ends of the inner and outer walls and a rear wall extending between the opposited ends of the walls. The front wall includes several apertures 23 which provide communication therethrough with the interior of the annular chamber 22. This permits air to freely circulate into and out of the chamber to reduce the concentration of heat within the chamber. The rear wall encloses the chamber 22 to prevent air from passing through the chamber to the exterior of the wall.

A perimetric flange 24 extends outwardly from the front end of the outer cylindrical wall 21. This flange 24 is sized and configured to cover that portion of the wall opening outward of the outer cylindrical wall. The wall opening is preferably formed in a generally circular shape and the flange 24 is then provided with a similarly circular shape slightly larger than the size of the opening. It will be appreciated, however, that the wall opening could be square, rectangular or otherwise shaped, and the flange can then be suitably shaped and sized to enclose these types of openings.

First mounting means are provided for mounting the cylindrical body member 19 to the flue thimble 14. The body member is mounted to have the inner cylindrical wall spaced apart from the outer surface of the flue thimble, thus providing an air space therebetween to enhance the insulating characteristics of the apparatus. In the preferred embodiment the first mounting means includes a plurality of oppositely positioned thumb screws 25 which are threadingly received through the inner and outer walls and bear against and engage the outer surface of the flue thimble.

Second mounting means are also included for mounting said cylindrical body member to the wall 11. The body member is positioned for mounting within the opening 12 in the wall to have the outer cylindrical wall spaced apart from the wall. This provides an insulating air space between the body member and the wall. In the preferred embodiment the second mounting means includes the action of the thumb screws in securing the body member to the flue thimble, and also includes apertures 26 in the flange 24, through which fasteners are received to secure the flange to the surrounding wall. In a typical application for a wooden, stud wall, the wall opening would be framed in the area surrounding the cylindrical body member, and the flange may be attached to the framing by nails extending through the apertures 26 and engaging the wooden framing.

Figure 3:
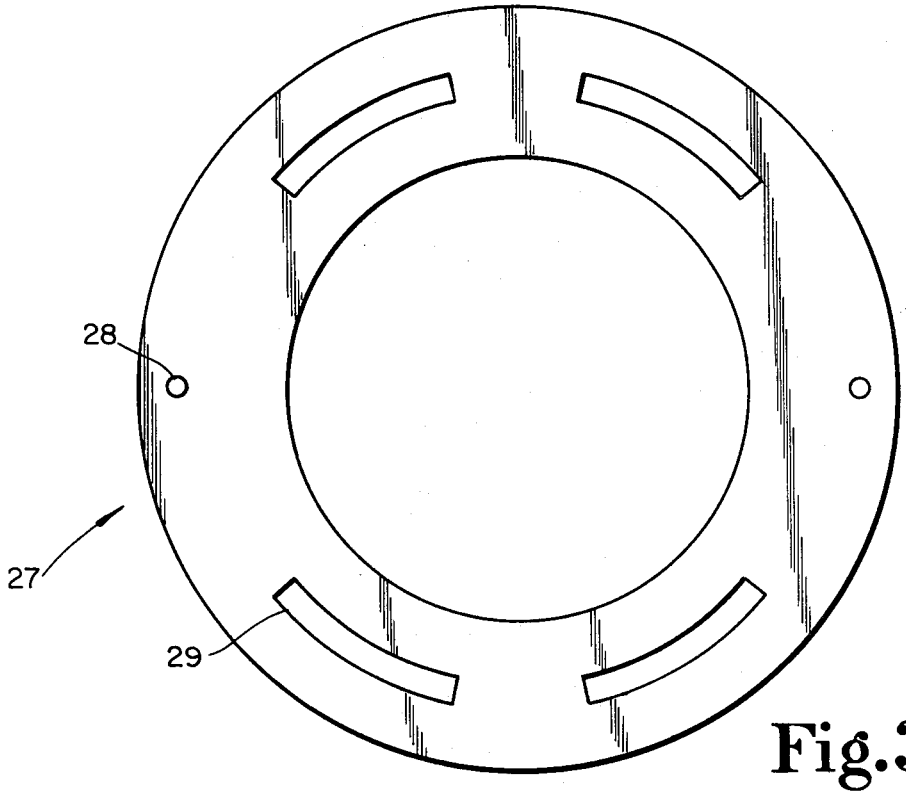
FIG. 3 is a front, elevational view of a cover plate useful with the present invention.

Upon installation of the body member within the opening in the wall, a cover plate 27 (FIG. 3) is secured over the body member. The cover plate has a generally disc shape. The inner diameter of the cover plate 27 is sized less than the inner diameter of the inner cylindrical wall of the body member. Further, the inner diameter of the cover plate is sized to closely receive a vent pipe extending therethrough. The cover plate has an outer perimeter sized and configured to cover the perimetric flange 24. In this manner the cover plate can be utilized to give the insulating apparatus a finished look with the vent pipe closely received and the cylindrical body member covered from view. Also, the cover plate provides an additional insulating factor since it closely conforms to the vent pipe and also fully covers the cylindrical body member. Means are provided for mounting the cover plate to the body member, preferably by mounting to the perimetric flange 24, such as by fasteners received through apertures 28 in the cover plate.

The cover plate is provided with apertures 29 which overlie at least some of the apertures 23 of the body member. Air is then permitted to enter through the apertures 29 and circulate into and through the annular insulating chamber 22 of the body member. The apertures 29 may have a variety of shapes, and may overlie each of the apertures of the body member if desired. It is considered desirable to have the cover plate be black in color, thereby minimizing the visibility of the apertures 29. It is also preferable that the cover plate be configured to be slightly spaced from the front end of the body member, thereby permitting free exchange of air with all of the apertures 23 of the body member.

By the described structure, an insulating apparatus is provided for use with a flue thimble received within a wall opening. The apparatus provides efficient insulation of the wall against the heat within the flue thimble, and thereby protects the wall from overheating and possible ignition. Three distinct insulating spaces are provided, namely the first space between the wall and outer cylindrical wall, a second space between the outer and inner cylindrical walls, and the third space between the inner cylindrical wall and the flue thimble. The unit insures proper protection of the surrounding wall structure, and at the same time provides an apparatus which can be readily installed. Further, the unit is attractive in appearance, and provides a finished look to the installation of the vent pipe into the flue thimble.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What I claim is:

1. An insulating apparatus for mounting within an opening in a wall or the like and for receiving a flue thimble extending through the opening, said apparatus providing for reception of a vent pipe within the flue thimble and for insulation of the adjacent wall against the heat of the vent pipe and flue thimble, said apparatus comprising:

a double-walled, cylindrical body member having inner and outer cylindrical walls defining an annular. insulating chamber therebetween, the inner diameter of the inner cylindrical wall being greater than the outer diameter of the flue thimble to enable the flue thimble to be received inside of the inner cylindrical wall, the outer diameter of the outer cylindrical wall being less than the size of the opening in the wall to enable the cylindrical body member to be received within the wall opening, said cylindrical body member including a front wall extending between first ends of the inner and outer cylindrical walls and a rear wall extending between the opposite ends of the inner and outer cylindrical walls, the front wall including several apertures providing communication to the annular, insulating chamber from exterior of said cylindrical body member, the rear wall being solid and thereby preventing communication therethrough to the annular, insulating chamber;

a perimetric flange extending outwardly from the front end of the outer cylindrical wall, said flange being sized and configured to cover that portion of the wall opening outward of the outer cylindrical wall;

first mounting means for mounting said cylindrical body member to the flue thimble to have the inner cylindrical wall spaced apart from the outer surface of the flue thimble;

second mounting means for mounting said cylindrical body member to the wall within the opening in the wall to have the outer cylindrical wall spaced apart from the wall, thereby providing an insulation of the wall against heat within the flue thimble by three separate insulating spaces including a first space between the wall and the outer cylindrical wall, a second space between the outer and inner cylindrical walls, and a third space between the inner cylindrical wall and the flue thimble;

a cover plate having an inner diameter sized less than the inner diameter of the inner cylindrical wall of said cylindrical body member, the inner diameter of said cover plate being sized to closely receive a vent pipe extending therethrough, said cover plate having an outer perimeter sized and configured to cover said perimetric flange;

aperture means for providing communication between the annular, insulating chamber of said cylindrical body member and the exterior of said cylindrical body member; and third mounting means for mounting said cover plate adjacent said perimetric flange.

2. The apparatus of claim 1 in which said first mounting means includes thumb screws extending through said cylindrical body member and engaging the outer surface of the flue thimble.

3. The apparatus of claim 1 in which said second mounting means includes securement means for securing said perimetric flange to the adjacent wall.

4. The apparatus of claim 3 in which the securement means includes apertures defined by said perimetric flange and further includes fasteners extending through the apertures in said flange and engaging the wall.

5. The apparatus of claim 4 in which said first mounting means includes thumb screws extending through said cylindrical body member and engaging the outer surface of the flue thimble.

* * * * *